United States Patent [19]

Auvil, Jr.

[11] 4,421,131

[45] Dec. 20, 1983

[54] CLEANING APPARATUS

[76] Inventor: Raymond G. Auvil, Jr., P.O. Box 789, Lone Pine, Calif. 93545

[21] Appl. No.: 340,736

[22] Filed: Jan. 19, 1982

[51] Int. Cl.[3] ..... B08B 3/04

[52] U.S. Cl. ..... 134/104; 134/110; 134/143; 134/155; 134/164

[58] Field of Search ..... 134/104, 109–110, 134/135, 143, 155, 164

[56] References Cited

U.S. PATENT DOCUMENTS

| | | | |
|---|---|---|---|
| 2,564,443 | 8/1951 | Palotsee | 134/104 X |
| 2,643,662 | 6/1953 | Bunce | 134/164 |
| 3,598,651 | 8/1971 | Valavaara | 134/104 X |
| 3,896,829 | 7/1975 | Sabatka | 134/143 X |
| 4,353,323 | 10/1982 | Koblenzer | 134/104 X |

*Primary Examiner*—Robert L. Bleutge

*Attorney, Agent, or Firm*—John H. Crowe

[57] ABSTRACT

A cleaning apparatus in which an item to be cleaned is lowered into a tank of cleaning solution by a basket having an imperforate floor, the floor and tank forming a relatively narrow opening therebetween. The floor forces the underlying solution to flow through the opening at a relatively high velocity to sweep with it any sludge or sediment which may have previously settled on the bottom of the tank. Such solution flows above the basket floor and washes against the item being cleaned. Any sediment entering the solution tends to settle on top of the floor. When the basket is raised, it enables a drainage passage to be opened, permitting a remaining portion of the solution as well as a rinsing liquid to flow along the floor and through the drainage passage, sweeping with it such sediment, etc., which had previously settled on the basket floor.

12 Claims, 11 Drawing Figures

FIG. 2.
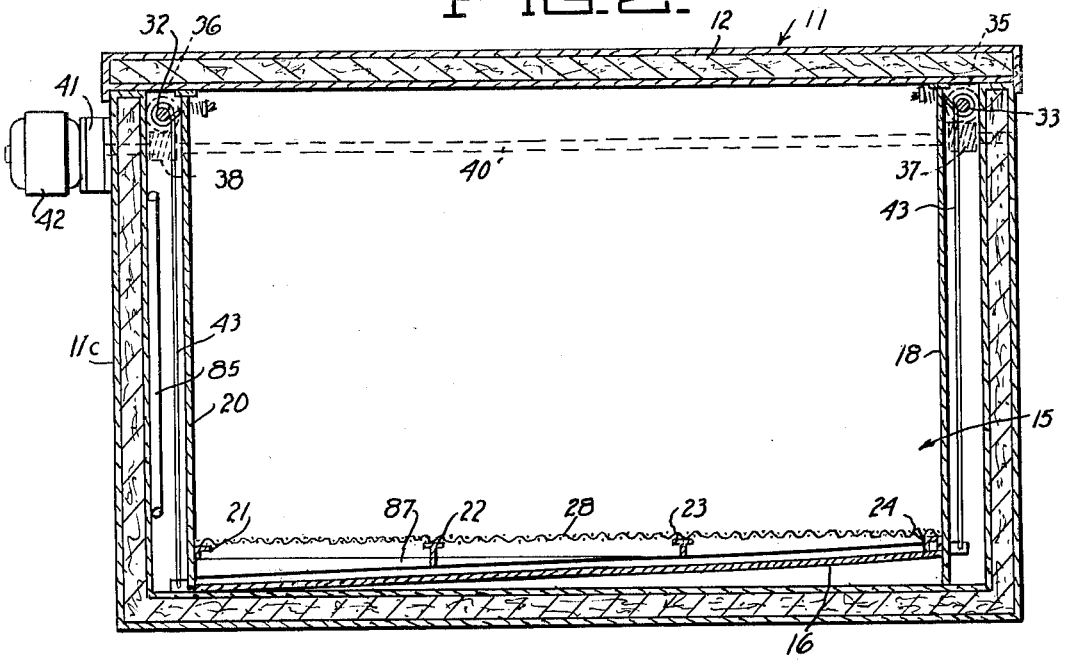
FIG. 4.
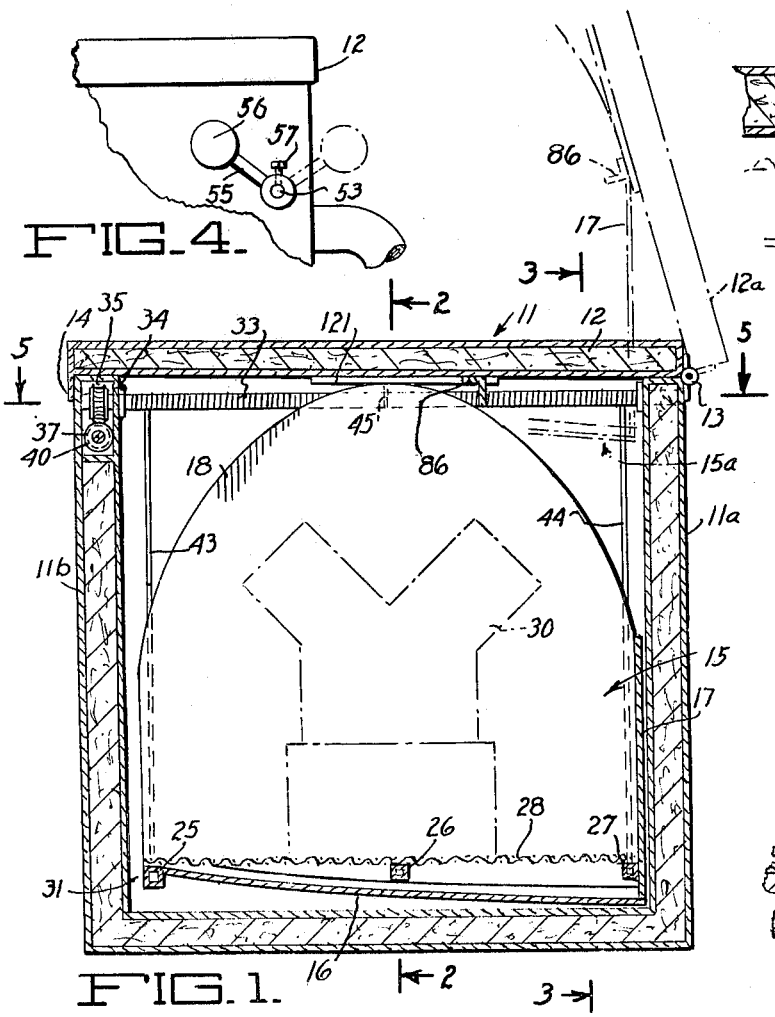
FIG. 1.
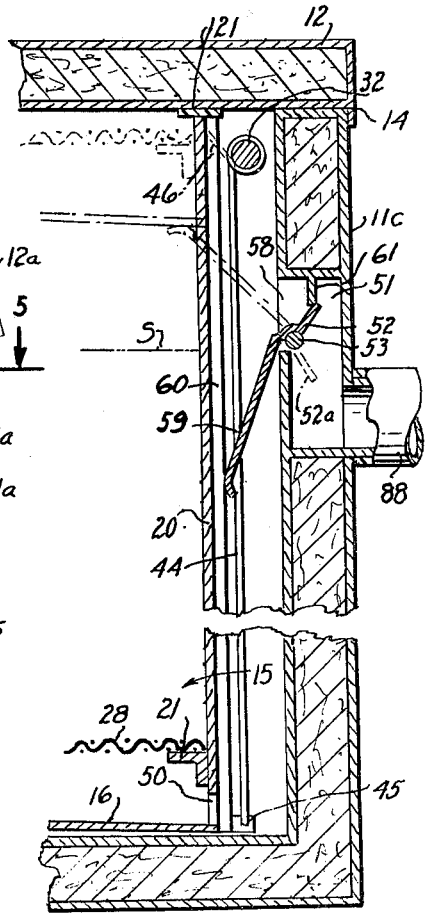
FIG. 3.

FIG. 5.
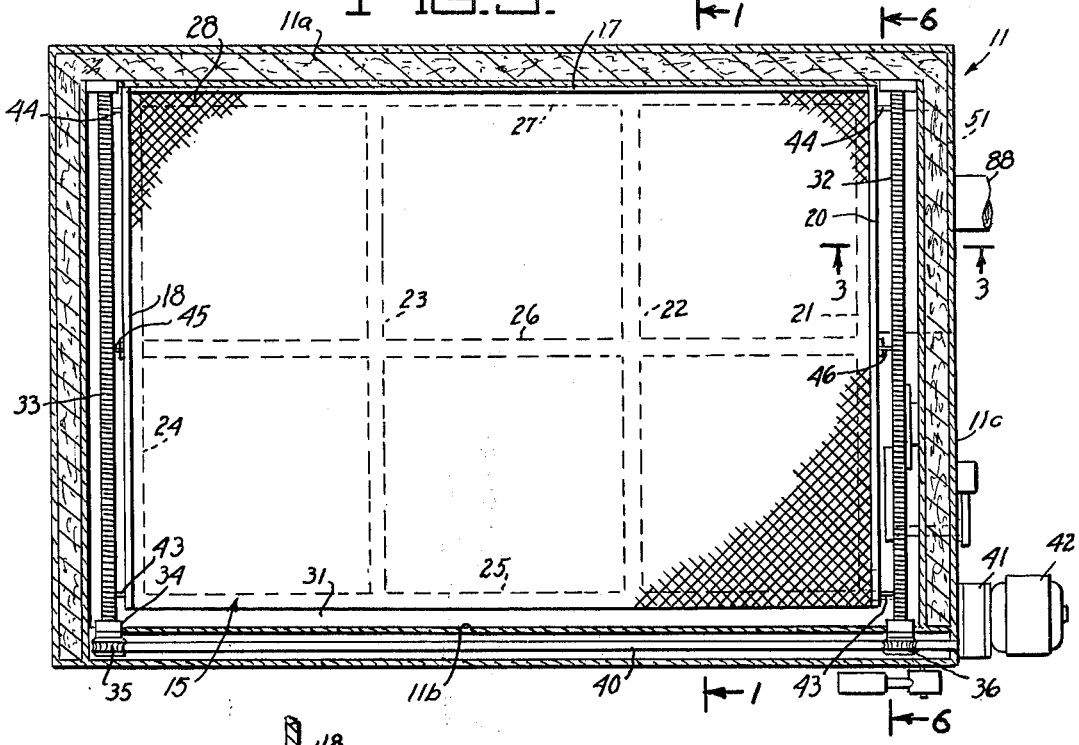
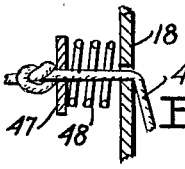
FIG. 7.
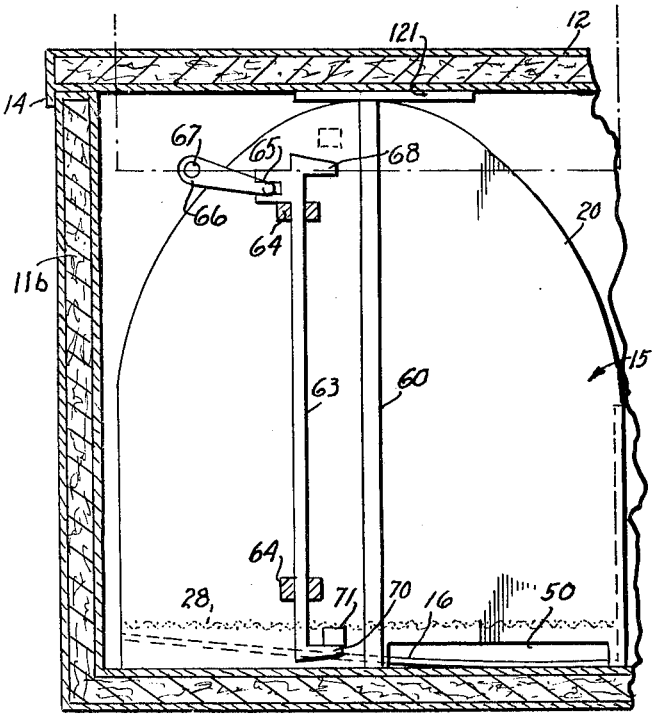
FIG. 6.
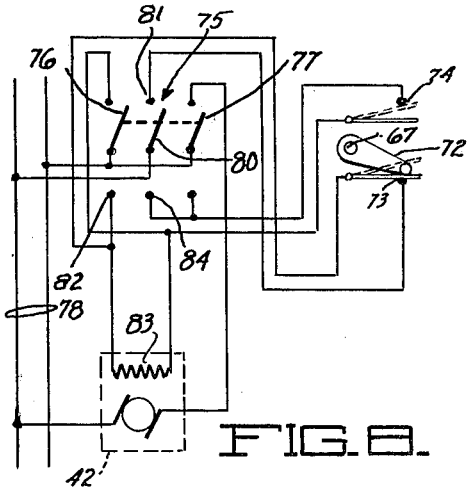
FIG. 8.

CLEANING APPARATUS

BACKGROUND OF THE INVENTION

1. Field of the Invention

This invention relates to cleaning apparatus and has particular reference to cleaning or degreasing apparatus for removing accumulated oil, grease and impacted dirt from such items as vehicle or industrial engines, drive units, and the like.

2. Description of the Prior Art

It is desirable, at times, to clean engines and other items or components which operate in or are located in the presence of oil or grease. Dust, dirt, sand and the like tend to adhere to the oil or grease, forming a coating which is difficult to remove. Heretofore, tanks of a suitable cleaning solution have been provided in which the items to be cleaned are immersed until the accumulated oil, grease and dirt are dissolved and settle to the bottom of the tank as sediment or sludge. Although such tanks are generally satisfactory, the sludge builds up on the floor of the tank, requiring the tank to be taken out of service periodically and the accumulated sludge removed from the tank. This, of course, requires additional work and interrupts the scheduling of cleaning operations. Also, as the sludge is removed from the tank, part of it again disperses in or clouds the solution and again settles to the tank bottom.

Further, as the sludge builds up in the tank, it tends to reduce the effectiveness of the cleaning solution, requiring relatively frequent replacement of the solution.

Additionally, such cleaning solutions are generally highly caustic and toxic, and when an item or items being cleaned are lowered or raised in the tank there is a tendency for the solution to splash on the workers. Also, the workers, in removing the items from the cleaning tank, must necessarily come in contact with the part of the solution adhering to the items, thereby mandating the use of protective gloves, clothing, etc.

SUMMARY OF THE INVENTION

A principal object of the present invention is to provide a cleaning apparatus of the above general type in which sludge entering the cleaning solutions from items being cleaned is continually removed from such solution.

Another object of the invention is to eliminate the need for periodic shutdown of cleaning apparatus of the above type to remove accumulated sludge from tank bottoms.

Another object is to eliminate splashing of the cleaning solution when an item to be cleaned is immersed in a cleaning tank and to eliminate any need for workers to come into contact with the solution at any time.

Another object is to provide power means for raising and lowering items into and out of a cleaning solution at a controlled rate.

According to the invention, a cleaning tank is provided containing a cleaning solution in which an item supporting basket is lowered and raised at a controlled rate under power. The basket has an imperforate or solid floor which slopes toward one corner of the tank and a perforated plate spaced thereabove for carrying the item or items to be cleaned.

When the basket is lowered in the tank, the cleaning solution is displaced upwardly around one edge of the floor. As the basket approaches its lowermost position, the solution remaining under the basket floor is displaced upwardly past the edge of the floor at a relatively high velocity and thus tends to sweep with it any sludge or sediment which may have previously settled to the bottom of the tank. Concurrently, the turbulent solution moving over the edge of the basket floor creates a wave which moves over the item being cleaned to aid in removing any accumulated dirt, etc., which may be compacted thereon.

Most of the removed material tends to drop through the perforated plate and settle on the basket floor. When the basket is subsequently raised, the solution drains downwardly over the aforementioned edge of the basket floor, into the underlying portion of the solution. However, obstructions, comprising partly the perforated basket plate, are provided over the floor to reduce the velocity of the portion of the solution lying directly above the floor as it drains back into the tank, so as to reduce any tendency for the sludge which has settled on said floor from being swept back into the underlying solution.

When the basket reaches its uppermost position it still contains a small amount of solution above its floor. Although this will tend to flow back into the tank, such flow will not be sufficient to carry any appreciable amount of sludge with it. However, when a drain valve in the side of the tank is opened and water or other rinsing liquid is applied to the item, it washes any sludge remaining on the item into the basket bottom and the resulting relatively large volume of such rinsing liquid will flow unimpeded over the basket floor and through the drain valve, readily carrying with it any sludge resting on the basket floor. Although a small volume of rinsing liquid may drain into the tank at this time from the basket floor, its flow will be so slow that little, if any, of the sludge will be carried back into the tank.

BRIEF DESCRIPTION OF THE DRAWINGS

The manner in which the above and other objects of the invention are accomplished will be readily understood on reference to the following specification when read in conjunction with the accompanying drawings, wherein:

FIG. 1 is a transverse sectional view of a cleaning or degreasing apparatus embodying a preferred form of the present invention, taken along line 1—1 of the plan view in FIG. 5.

FIG. 2 is a longitudinal sectional view taken along line 2—2 of FIG. 1.

FIG. 3 is an enlarged sectional view, partly broken away, taken along line 3—3 of FIG. 1 and of FIG. 5.

FIG. 4 is a fragmentary front view showing the drain valve operating handle.

FIG. 5 is a sectional plan view taken along the line 5—5 of FIG. 1.

FIG. 6 is a sectional side view, partly broken away, taken along line 6—6 of FIG. 5.

FIG. 7 is a fragmentary sectional view illustrating the tensioning device for one of the basket moving cables.

FIG. 8 is a schematic diagram of the electrical circuit for controlling the apparatus.

DESCRIPTION OF THE PREFERRED EMBODIMENT

Figure 9:
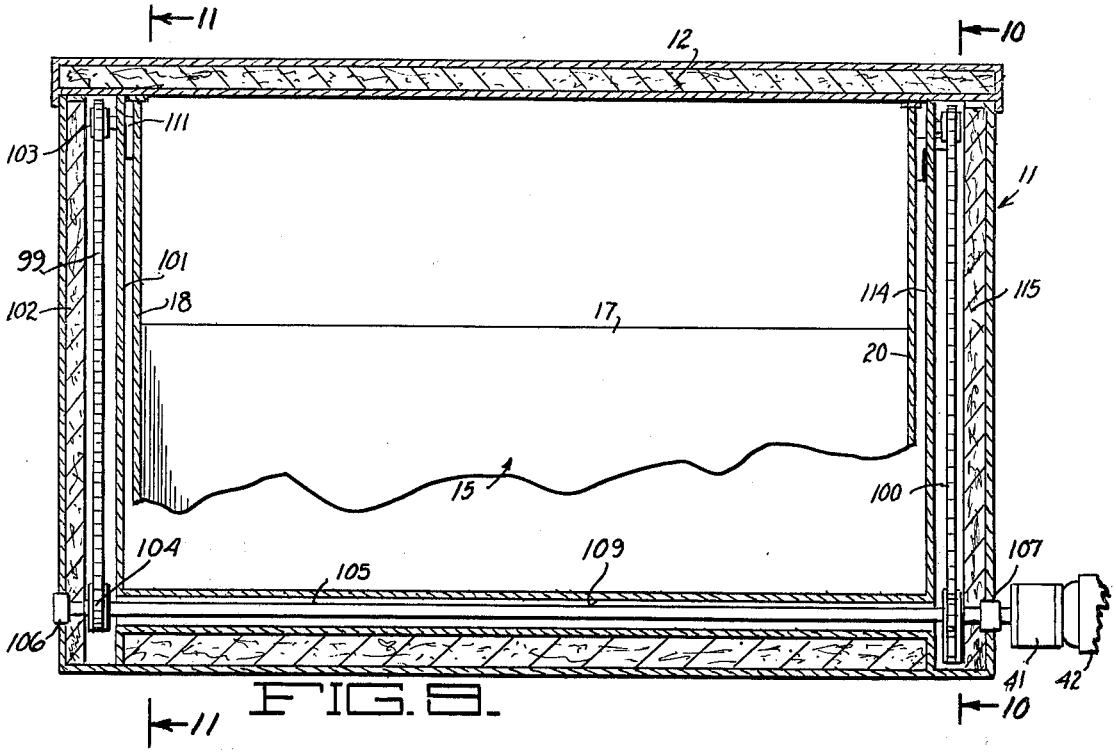
FIG. 9 is a longitudinal sectional view taken through a modified form of the invention, taken along the line 9—9 of FIG. 10.

While this invention is susceptible to embodiment in many different forms, there is shown in the drawings and will be described in detail one specific embodiment and a modified embodiment, with the understanding that the present disclosure is to be considered an exemplification of the principles of the invention and is not intended to limit the invention to the particular embodiments illustrated.

Referring in particular to FIGS. 1 though 8, the cleaning apparatus comprises a heat insulating tank, generally indicated at 11, having a double wall filled with insulating material, such as Styrofoam. A heat insulating cover 12, also comprising a double wall filled with insulating material is pivoted to the rear of the tank at 13 (FIG. 1) for movement between its full line closed position shown in FIG. 1 and its open position indicated by dot-dash lines 12*a*. A lip 14 extends downwardly around the cover to aid in sealing against the escape of steam and other vapors when the cover 12 is closed.

An item-supporting basket generally indicated at 15, is supported within the tank 11 and comprises an imperforate floor 16 to which are attached a rear wall 17 and end walls 18 and 20. The upper edges of the side walls 18 and 20 are curved convexly and slidably engage runner strips 121 of plastic or other nonfrictional material integrally secured to the underside of the cover 12.

It will be noted that the basket floor 16 is not horizontal but slopes downwardly toward the rear of the tank as seen in FIGS. 1 and 6 and also slopes downwardly toward the right hand end of the tank as seen in FIG. 3 (toward the left as seen in FIG. 2). Elongate braces 21 to 27, FIGS. 1, 2 and 5, are secured in a horizontal plane to the basket 15 adjacent the floor 16 to support an apertured plate 28 in a horizontal position. The plate 28 may be of heavy wire mesh or expanded metal for supporting an item such as shown in dot-dash lines 30 to be cleaned.

The rear wall 17 of the basket may slidably engage the rear wall 11*a* of the tank but a narrow space 31, preferably of about 2.5 cm (1 inch), is formed between the front edge of the floor 16 and the front wall 11*b* of the tank, the purpose of which will be disclosed later.

Means are provided to raise and lower the basket 15 at a controlled rate between its lowermost position shown in full lines in FIG. 1 and its upper position, partly shown by dot-dash lines 15*a*. For this purpose, helically threaded drums or shafts 32 and 33 are rotatably mounted in bearings 34, mounted in the rear and front walls 11*a* and 11*b*, respectively, of the tank. Such shafts are provided with worm gears 35 and 36 which mesh with drive worms 37 and 38, respectively, mounted on a drive shaft 40. The latter is connected through a suitable transmission unit 41 to a reversible motor 42 located exteriorally of the tank.

Two pairs of cables 43, 44 are provided at opposite ends of the tank and each cable is suitably attached at one end to the associated shaft 32 or 33 and is attached at its opposite end 45 (FIG. 3) to the lower end of the basket. The various cables 43 and 44 are wound in the same direction around the shafts 32 and 33. Rotation of the shafts will cause a vertical movement of the basket 15. Two additional cables 45 and 46 at opposite ends of the basket 15 are each suitably attached at one end to the respective shaft 32 or 33. The latter cables are wound in a direction opposite that to the winding of cables 43 and 44 and are suitably attached at their opposite ends to upper ends of the basket end walls 18 and 20. In order to maintain the cables taut at all times, the upper end of each of the cables 45 and 46 is slidably extended through a hole 49 in the respective end wall (that in end wall 18 being illustrated in FIG. 7) and is attached to a spring retainer disc 47. A stressed compression spring 48 is interposed between the end wall 18 and the retainer disc 47, thus holding the cable 45 under tension.

Accordingly, rotation of the motor 42 in a first direction will cause the cables 43 and 44 at the opposite ends of the basket to raise the basket 15 from its lower position toward its upper position 15*a* and rotation of the motor in a second or opposite direction will cause the cables 45 and 46 to lower the basket toward its lower position.

As seen in FIGS. 3 and 6, a narrow horizontally extending slot 50 is formed in the right hand end wall 20 of the basket 15. This slot opens over substantially the rear half of the basket floor 16 to permit the draining of cleansing liquid or rinsing liquid, such as water, along with particles of sludge and sediment, from the floor 16 when the basket is in its upper position. A chamber 51 is formed in the right hand end wall 11*c* of the tank directly in line with the vertical path of movement of the slot 50. A drain valve 52 extending the width of the chamber 41 is located in the chamber and is fixed to a control rod 53 which is rotatably supported in bearings (not shown) formed in the front and rear walls of the tank. A handle 55 (FIG. 4) carrying a weight 56 is attached, by means of a clamp screw 57, to the rod 53 exteriorally of the tank.

A portion 59 of the drain valve 52 extends through an opening 58 in tank wall 11*c* and normally rides against a brace bar 60 suitably attached to the basket end wall 20 to maintain the drain valve closed against a vertical lip 61 depending from the top of the chamber 51.

Means are provided for controlling the operation of the motor to raise or lower the basket 15 between its upper and lower positions. For this purpose, a control bar 63, FIG. 6, is slidably mounted in bearings 64 attached to the side wall 11*c* of the tank. This bar is connected by a pin and slot connection 65 to a switch control lever 66 attached to a switch shaft 67 (see also FIG. 8). The bar 63 has laterally extending feet 68 and 70 at the opposite ends thereof which are located in the path of a projection 71 extending from the end wall 20 of the basket. The control shaft 67 is rotatably mounted in suitable bearings formed in the tank wall 11*a* and is attached to a second switch control arm 72. When the basket 15 is in its lower position, the projection 71 holds the bar 63 in its lower position illustrated in FIG. 6 to cause the arm 72 to close a normally open switch 73 and to permit a second normally open switch 74 to open. However, when the basket 15 is raised to its upper position, the projection 71 raises the bar 63 and thus causes the switch control arm 72 to rock counterclockwise, closing switch 74 and opening switch 73.

A triple pole reversing switch 75 is provided having its two outer movable blades 76 and 77 connected to one side of an AC power circuit 78. The remaining inner blade 80 of switch 75 is connected to the opposite side of the circuit 78. The upper central switch contact 81 is connected through the lower limit switch 73 to the lower left hand switch contact 82 and one side of the field winding 83 of motor 42. The lower central contact 84 is connected through the upper limit switch 74 to the upper left switch contact and to the opposite side of the motor field winding 83. Accordingly, when the basket is in its lower position with the switch 72 closed, throwing of switch blades 76, 77 and 80 into their upper switching positions will cause the motor to rotate in one direction to raise the basket 15 until it reaches its upper position at which time the lower limit switch 73 will be opened and the upper limit switch 74 will be closed. When the basket is in its upper position with the switch closed, throwing of the switch blades 76, 77 and 80 to their lower positions will cause the motor to rotate in the opposite direction to positively lower the basket until it reaches its lower position at which time the limit switch 74 will be open.

Obviously, movement of the switch blades 76, 77 and 80 to an intermediate position will stop the motor and basket 15 in an intermediate position.

Describing now the operation of the apparatus, the tank 11 is filled with a suitable liquid cleaning solution to approximately the level indicated at S in FIG. 3. The solution is preferably heated by a thermostatically controlled heater element 85, FIG. 2, to a temperature just below the boiling point of the solution. Assuming the basket 15 is in its lowermost position, the switch blades 76, 77 and 80 are first moved to their upper switching positions, causing the basket to be raised. In doing so, the upper edges of the basket end walls 18 and 20 engage the cover 12 swinging the same to its open position 12*a*. When the basket reaches such upper position, the upper edge of the back wall 17 engages a cross-piece 86 on its cover 12 to form a liquid seal. The item to be cleaned is placed on the apertured plate 38 and the switch blades 76, 77 and 80 are moved to their lower switch positions, causing the basket to lower the item into the cleaning solution.

An important feature of this invention is that as the basket is lowered, the imperforate basket floor 16 forces the underlying cleaning solution upwardly through the relatively narrow opening 31 at a relatively high velocity. Thus, as the basket nears its lower position, the underlying solution will pick up or sweep forwardly any sludge or sediment, including solid particles such as rocks, that may have settled on the bottom of the tank and will then carry these upwardly through the opening 31 and over the forward edge of the floor 16, upon which they will subsequently tend to settle. As the basket is lowered, its end walls 18 and 20 permit the cover 12 to close under the force of gravity to seal off any toxic or corrosive vapors from the cleaning solution.

While the cover is in its closed condition, the heater element 85 heats the cleaning solution, developing convection currents which causes the solution to flow around the item 30 to dislodge any impacted oil, grease and/or dirt adhering thereto. The latter tend to settle downwardly as sludge and drop through the apertured plate 28 onto the floor 16. After a period sufficient to insure proper cleaning of the item, the switch blades 76, 77 and 80 are again thrown to their upper switching positions, causing the motor 42 to raise the basket at a controlled rate of speed such that no splashing occurs. During this time, the cleaning solution passes from above the floor 16 and downwardly though the opening 31. However, the velocity of that portion of the solution directly above the floor 16, which tends to flow downwardly through the opening 31, is reduced by the apertured plate 28 and certain of the braces 21 to 27, as well as by depending fins 87 which extend downwardly from the brace bars (see, for example, brace bar 26) to positions only slightly above the surface of the floor 16. Thus, the major portion of the sludge and sediment remains on the top surface of the floor 16.

As the basket 15 is raised, the bar 60 on the basket side wall 20 wipes along the extending portion 59 of the drain valve 52, holding the valve in closed condition as shown in FIG. 3, thus preventing any of the cleaning solution from entering the draining chamber 51. However, as the basket reaches its uppermost position, its floor 16 passes above the tail portion 59 of the valve. The handle 55 can then be rocked clockwise to move the drain valve to its open position shown by dot-dash lines 52*a* where it will be held by the weight 56. In such position of the basket, the slot 50 is located directly above the tail portion 59 of the drain valve so that the latter forms a sluice to convey any liquid from the basket floor 16, over the floor, through the chamber 51, and into a drain pipe 88.

It will be noted that when the basket is in its upper position, the floor 16 largely seals the tank, except for the narrow opening 31. At this time, a rinsing liquid, such as water, may be applied against the item 31 by means of a hose (not shown) or otherwise. Such liquid will wash off any remaining sludge and will drain to the bottom of the basket where it will sweep any sludge resting on the basket floor out through the drain valve. Since the volume of liquid flowing through the drain valve is far greater than that draining back into the tank through the opening 31, most of the sludge will be carried out through the drain valve and little, if any, will be carried back into the tank.

When the basket 15 is subsequently lowered to clean another item, it will rock the drain valve 52 to its closed position if it is not already closed by the handle 55.

It will be noted from the foregoing that the cable drive shafts 32, 33 and 40, and other parts of the cable drive system, are continually maintained out of contact with cleaning solution and are therefore not subjected to any corrosive action by the cleaning solution.

DESCRIPTION OF THE ALTERNATIVE EMBODIMENT

Figure 11:
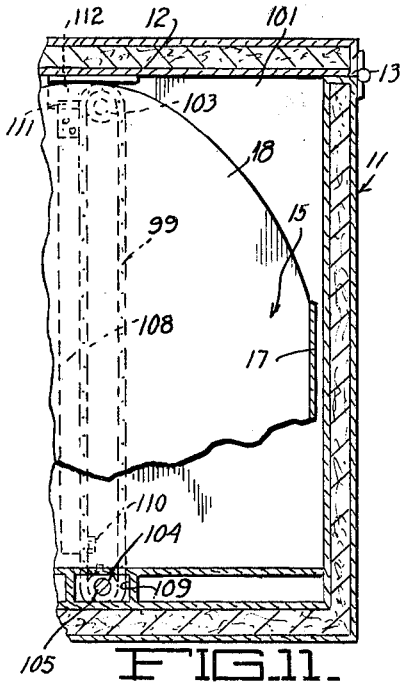
FIG. 11 is a transverse sectional view, partly broken away, taken substantially along the line 11—11 of FIG. 9.
Figure 10:
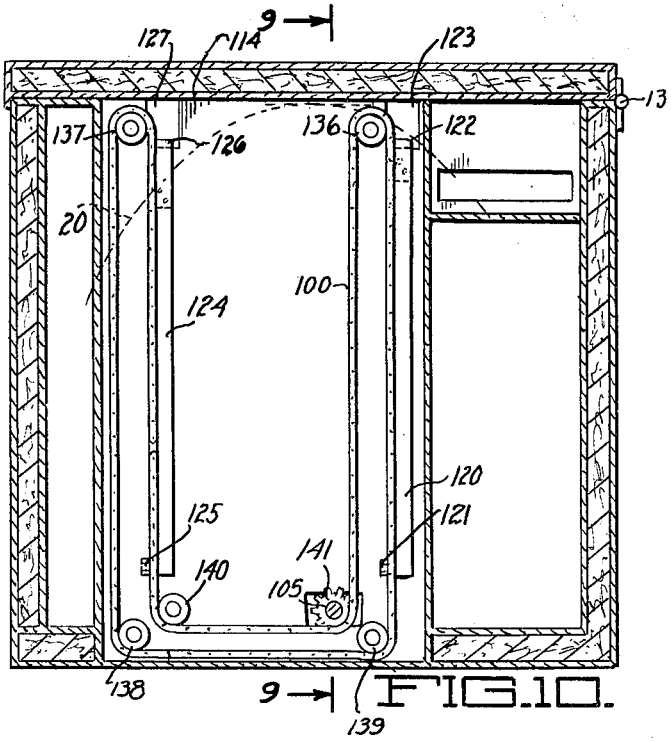
FIG. 10 is a transverse sectional view taken substantially along the line 10—10 of FIG. 9.

FIGS. 9 to 11, inclusive, illustrate a modified form of the invention and are directed to an alternative form of mechanism for raising and lowering the basket 15. The basket and drain valve, along with their functions, are similar to those disclosed in connection with FIGS. 1 to 8 and therefore such mechanism is omitted in FIGS. 9 to 11 for the purpose of brevity. Those elements which are similar to those shown in FIGS. 1 through 8 will be designated by the same reference numerals.

In lieu of the cable system for raising and lowering the basket 15, a chain system is provided comprising a first endless chain 99 (FIGS. 9 and 11) at the left hand of the tank. Chain 99 is located intermediate a wall panel 101 and a layer 102 of insulating material forming part of the left hand wall of the tank. The chain is guided at its upper end over a guide pulley 103 and meshes at its lower end with a sprocket 104 mounted on a drive shaft 105. The latter is journaled in bearings 106 and 107 and is driven by reversible motor 42 though drive unit 41. The shaft 105 extends through a channel 109 formed at the bottom of the tank. A vertical rod 108 is secured at its lower end at 110 to one strand of the chain 99 and has a cross-piece 111 which extends laterally through a slot 112 in wall panel 101 and is integrally attached to the side wall 18 of the basket.

A second endless chain 100 (FIGS. 9 and 10) is located at the right hand side of the tank between a wall panel 114 and a layer of insulation 115 forming part of the right hand wall of the tank. The chain 100 is guided over pulleys 136 to 140, inclusive, and meshes with a sprocket 141 fixed on shaft 105. A vertical rod 120 is attached at its lower end at 121 to one strand of the chain. An integral cross-piece 122 at the upper end of rod 120 extends through a slot 123 in the wall panel 114 and is suitably attached to the side wall 20 of the basket 15. A second vertical rod 124 is attached at 125 to another strand of chain 113 and has a cross-piece 126 at its upper end which extends through a second slot 127 in wall panel 114 and is also suitably attached to the basket wall 20.

It will be noted from reference to FIGS. 10 and 11 that the rods 108, 120 and 124 support the basket at three spaced points so as to maintain the basket 15 against any tilting forces which may be applied to it.

When the motor 42 is energized by controls similar to those shown in FIGS. 1 through 8, the shaft 105 will be rotated clockwise, as seen in FIGS. 10 and 11, causing the sprockets 104 and 141 to drive the chains 99 and 100 in a manner to raise the rods 108, 120 and 124 in a parallel manner to thus raise the basket 15. Upon reversal of the motor 42, the shaft 105 will be rotated counterclockwise to lower the rods 108, 120 and 124, and the basket, in a parallel manner.

It will be noted from the foregoing that chains 99 and 100, along with the drive shaft 105 and the various rollers supporting the chains, are always maintained out of contact with the cleaning solution within the tank.

I claim:

1. Cleaning apparatus comprising:

a tank for containing a cleaning liquid, a basket for supporting an item having sediment adhering thereto, said basket having an imperforate floor, one side of said tank and said floor forming an opening therebetween, and drive means for lowering said basket from a raised position to a lowered position in said liquid to convey the portion of said liquid below said floor through said opening and over said item, whereby to cause said portion of said liquid to sweep any sediment from the bottom of said tank through said opening and to deposit said sediment on top of said floor.

2. Cleaning apparatus as defined in claim 1 wherein said drive means is effective to raise said basket to said raised position, and drain means effective when said basket is in said raised position to drain any of said liquid and sediment from the top of said floor to the exterior of said tank.

3. Cleaning apparatus as defined in claim 2 wherein said drain means comprises a drain valve, and means for opening and closing said drain valve.

4. Cleaning apparatus as defined in claim 3 comprising means controlled by said basket for closing said drain valve upon lowering of said basket.

5. Cleaning apparatus as defined in claim 2 comprising a cover for said tank, and means controlled by said basket for causing opening of said cover when raising said basket and for causing closing of said cover upon lowering of said basket.

6. Cleaning apparatus as defined in claim 2 wherein said floor slopes downwardly toward one corner thereof.

7. Cleaning apparatus as defined in claim 6 comprising a perforated plate supported above said floor by said basket and extending substantially horizontally for supporting said item.

8. Cleaning apparatus as defined in claim 2 wherein said drive means comprises a pair of rotatable drum means at opposite ends of said tank, means for supporting said drum means above the level of said liquid, first cables wrapped around said drum means in one direction and attached to lower portions of said basket, second cables wrapped around said drum means in the opposite direction and attached to upper portions of said basket, and means for selectively rotating said drum means in either of opposite directions whereby to raise or lower said basket.

9. Cleaning apparatus as defined in claim 2 wherein said tank comprises end and bottom walls, a pair of endless chains at opposite ends of said tank, said chains being exterior of said tank, drive means including a drive shaft extending exteriorally of said tank, sprocket means on said shafts and meshing with said chains, vertically movable actuator elements attached to said chains exteriorally of said tank, said actuator elements extending over said end walls and attached to said basket, and means for selectively rotating said drive means in either of opposite directions whereby to raise or lower said basket.

10. Cleaning apparatus as defined in claim 1 comprising means for retarding the flow of said liquid over said floor.

11. Cleaning apparatus as defined in claim 1 comprising upstanding walls on the sides of said basket facing the remaining sides of said tank.

12. Cleaning apparatus as defined in claim 1 wherein said drain valve comprises a liquid conveying member effective to convey said liquid and sediment from said floor to said drain means.

* * * * *